United States Patent [19]

Meloni

[11] 4,056,332

[45] Nov. 1, 1977

[54] COOLED TURBINE BLADE

[75] Inventor: Beat Meloni, Zurich, Switzerland

[73] Assignee: BBC Brown Boveri & Company Limited, Baden, Switzerland

[21] Appl. No.: 683,488

[22] Filed: May 5, 1976

[30] Foreign Application Priority Data

May 16, 1975 Switzerland ..... 6370/75

[51] Int. Cl.[2] ..... F01D 5/18

[52] U.S. Cl. ..... 416/97 A; 415/115

[58] Field of Search ..... 416/96, 96 A, 92, 97, 416/97 A; 415/115

[56] References Cited

U.S. PATENT DOCUMENTS

| | | | |
|---|---|---|---|
| 2,823,894 | 2/1958 | Gerdan et al. | 416/92 |
| 2,873,944 | 2/1959 | Wiese et al. | 416/92 |
| 2,920,866 | 1/1960 | Spurrier | 416/92 |
| 3,191,908 | 6/1965 | Powell et al. | 416/96 |
| 3,475,107 | 10/1969 | Auxier | 416/96 A X |
| 3,540,810 | 11/1970 | Kercher | 416/96 A |
| 3,560,107 | 2/1971 | Helms | 416/90 |
| 3,644,060 | 2/1972 | Bryan | 416/97 |
| 3,726,604 | 4/1973 | Helms et al. | 415/115 |
| 3,767,322 | 10/1973 | Durgin et al. | 416/96 A |

FOREIGN PATENT DOCUMENTS

| | | | |
|---|---|---|---|
| 676,713 | 12/1963 | Canada | 416/97 |
| 1,007,303 | 5/1952 | France | 416/97 |
| 723,394 | 2/1955 | United Kingdom | 416/96 A |
| 1,388,260 | 3/1975 | United Kingdom | 416/97 |

*Primary Examiner*—Everette A. Powell, Jr.
*Attorney, Agent, or Firm*—Pierce, Scheffler & Parker

[57] ABSTRACT

A turbine blade includes a longitudinally extending cavity into which air for cooling the interior wall of the blade is admitted. The air passes from the cavity through each of a group of inserts each of which is constituted by a plurality of stepped overlapping walls with spaced air passages therethrough, these walls establishing therebetween corresponding cooling spaces interconnected by the passages and which are bounded at one side by the blade wall. The cooling air passes in succession through the cooling spaces of each insert and is discharged from the insert and thence from the blade through an outlet port formed in the blade wall and which is connected to the last cooling space of each insert through which the air is passed. The passages through the overlapping walls also provide impingement cooling of the blade wall. The outlet ports for the cooling air are formed in the suction side of the blade as well as in its trailing edge.

3 Claims, 2 Drawing Figures

COOLED TURBINE BLADE

This invention concerns an improved construction for a cooled turbine blade provided with one or more cavities and with inserts which form various cooling spaces, and also cooling-air outlet ports on the blade surface.

Turbine blades, preferably for gas turbines, through which cooling air flows and which comprise an outer shell and at least one insert such that the insert is located against projections on the inner surface of the outer shell, whereby these projections are arranged in a direction transverse to the blade, forming cooling-air channels therebetween, are already known to the art. In U.S. Pat. No. 3,809,494, for example, a construction is described whereby the cooling-air is supplied to an inner cavity of the insert by a compressed-air source and flows into the turbulence space through openings in the insert, the result being that the inlet edge of the blade is cooled by so-called impingement cooling. From the turbulence space the cooling air then flows on both sides of the insert in the cooling-air channels formed between the projections on the inner wall of the outer shell, and thence to the trailing edge of the blade, in the region of which there are outlet ports.

According to another construction which has been used hitherto, the turbulence space on the suction side of the blade is isolated by a sealing strip from the cooling-air channels on the suction side in such a way that the cooling-air channels pass along the pressure side of the blade to the trailing edge of the blade, and from there along the suction side of the blade back to the region of the inlet edge of the blade, again outlet ports being provided in the region of the trailing edge of the blade for the cooling air flowing in the cooling channels.

With the known configurations, however, it is difficult under certain circumstances, for example with relatively low cooling-air flow rates and high temperatures at the outer surface of the blade, to achieve uniform and adequate cooling in all areas of the blade. A further disadvantage is that the cooling efficiency is impaired by the transverse flow inside the blade, since the intensity of impingement cooling decreases owing to the transverse flow.

The principal object of the invention is to create a cooled turbine blade structure such that in the case of blades with large surface areas a uniform cooling is obtained over the whole surface, such that the intensity of impingement cooling is nearly as constant as possible, and such that no excessively large cooling-air requirement is necessary for cooling these large areas.

This objective is achieved according to the invention in that the blade inserts comprise stepped overlapping walls and cooling-air discharge ducts.

The particular advantage of the proposed arrangement lies in the fact that, owing to the resulting multiple division of the cooling-air flow path, the cooling air is utilised more than once, thus increasing the cooling capacity and so decreasing the cooling-air requirement.

In a preferred structural arrangement, turbulence spaces are provided between the stepped overlapping walls and the inner surfaces of the blade walls, the stepped overlapping walls conveniently incorporating cooling-air passages for impingement cooling.

Further, the cooling-air passages in the stepped overlapping walls can be arranged in groups of rows, and also form several cooling-air stages.

These configurations allow the cooling air from the inner space in the blade to be passed through a channel formed by the stepped overlapping walls to the inside surface of the blade wall to be cooled in such a way that it impinges repeatedly on the wall being cooled. Owing to overlapping of the individual channels formed by the stepped overlapping walls, the cooling air is so directed that after the second channel it again impinges on the inside surface of the blade wall. This arrangement gives rise to a number of cooling stages, resulting in thorough utilisation of the cooling air.

According to a further development of the invention the cooling-air discharge ducts are connected to one of the cooling stages.

In order to make repeated use of the same cooling air it must be discharged at a point on the turbine blade which exhibits a suitable static pressure. Such points are located preferably on the suction side of the turbine blade and also at the trailing edge of the blade. The trailing edge of the turbine blade is then cooled simultaneously by impingement, film and convective cooling, the effectiveness of convective cooling being increased by pins located inside the blade.

A preferred embodiment of a cooled turbine blade according to the invention is shown in the accompanying drawings, in which.

Figure 1:
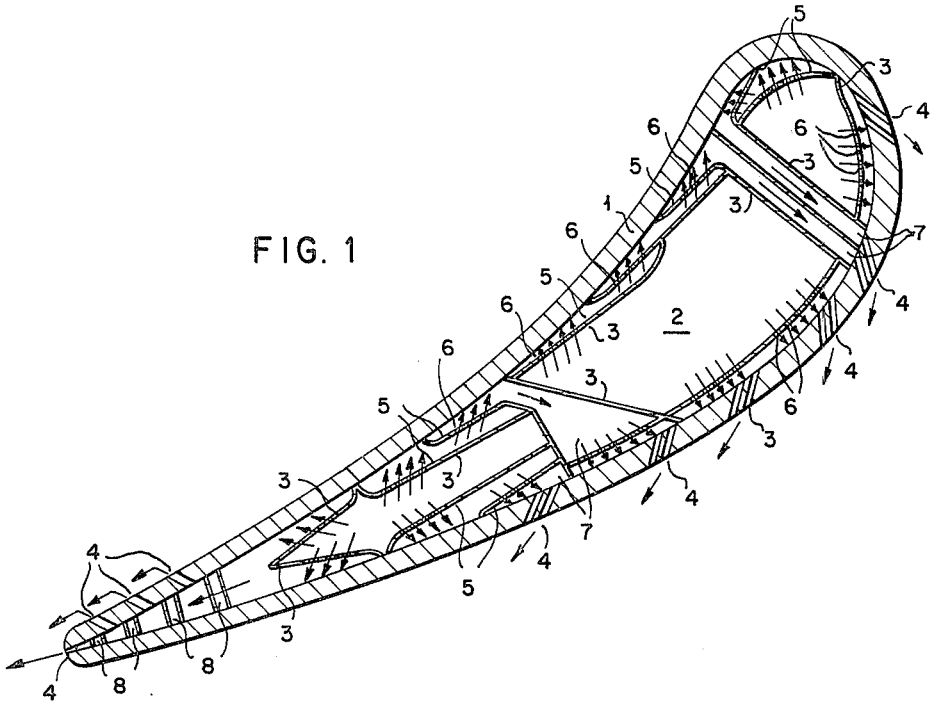
FIG. 1 is a view in cross-section through the cooled turbine blade.

With reference to the drawings FIG. 1 shows a hollow turbine blade 1 in the inner cavity 2 of which are located a number of inserts 3 which in turn form individual cooling spaces. The wall of the turbine blade 1 is provided with cooling-air outlet ports 4, both on the suction side of the turbine blade and at its trailing edge. The inner cavity 2 of the turbine blade 1 also contains stepped overlapping walls 5 with cooling-air passages 6. The stepped overlapping walls 5 are arranged in groups of rows, and preferably located at the inner surface of the pressure side of the turbine blade 1 such that they form a number of cooling stages. The individual cooling stages are connected to cooling-air discharge ducts 7 which lead to the cooling-air outlet ports 4 in the wall of the turbine blade 1. In the inner cavity 2 close to the trailing edge of the turbine blade 1, pins 8 are provided which are also exposed to the departing cooling-air flow and thus increase the effectiveness of convective cooling.

Figure 2:
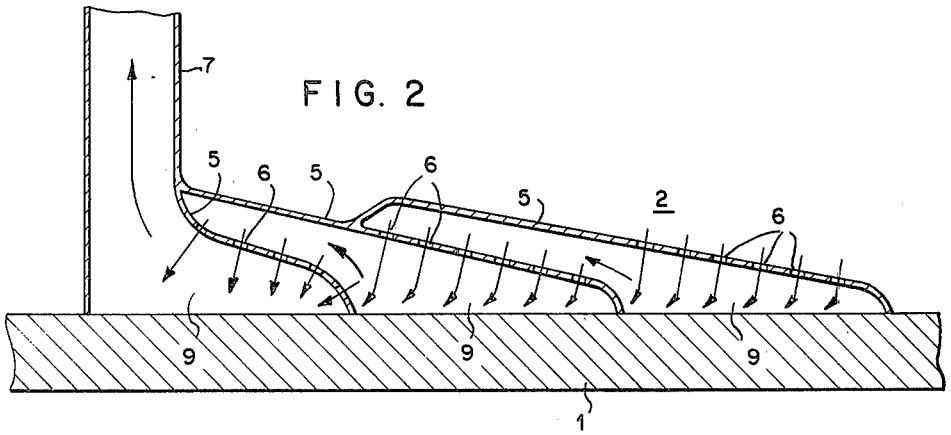
FIG. 2 shows a detail of the stepped overlapping walls arrangement inside the turbine blade of FIG. 1, and drawn to a larger scale.

In FIG. 2, identical parts are identified by the same reference symbols as in FIG. 1. FIG. 2 shows a part of the wall of the turbine blade 1, to the inside surface of which the stepped overlapping walls 5 with cooling-air passages 6 are attached, the last of the stepped overlapping walls 5 terminating at the cooling-air discharge duct 7. The arrows denote the flow direction of the cooling air.

The blade cooling arrangement described functions in the following manner:

Through a cooling-air supply duct (not shown) cooling air is fed into the inner cavity 2 of the turbine blade 1 preferably from the blade root to the blade tip. The cooling air flows around the inserts 3 and also the stepped overlapping walls 5 such that, divided a number of times by the cooling-air passages 6, it passes from one channel formed by the walls 5 into the next channel along the inner wall of the turbine blade 1, cools the latter and finally is directed through the cooling-air discharge duct 7 to the cooling-air outlet ports 4, which are preferably located on the suction side of the turbine blade. The cooling air directed to the trailing edge of the turbine blade 1 flows around the pins 8 located there and thus provides a convective cooling action, this action being enhanced by the pins 8.

As used in the specification and in the appended claims, the term "turbine blade" is intended to include the blading on the rotor component as well as the blading on the stator component which is commonly specifically referred to as guide vanes.

I claim:

1. A turbine blade including a cavity extending generally longitudinally therein and into which air for cooling the interior wall of the blade is admitted, a plurality of inserts disposed in the cavity adjacent the interior wall of the blade and arranged in a row between the leading and trailing edges thereof, each said insert being constituted by a plurality of stepped overlapping walls with air passages therethrough and which establish therebetween corresponding adjacent air turbulence and cooling spaces interconnected by said passages and bounded respectively at one side by the interior blade wall, the cooling air passing from said cavity into and through the cooling spaces of each said insert in succession for impingement upon the blade wall and being discharged to the exterior of the blade through an outlet port formed in the blade wall.

2. An air cooled turbine blade as defined in claim 1 wherein said air passages through said stepped overlapped walls of each insert are arranged in groups of rows.

3. An air cooled turbine blade as defined in claim 1 wherein said outlet port is located at the suction side of the blade.

* * * * *